US007597094B2

(12) United States Patent
Pittman

(10) Patent No.: US 7,597,094 B2
(45) Date of Patent: Oct. 6, 2009

(54) COMPOUND BOW MAINTENANCE PRESS AND METHOD FOR COMPRESSING A COMPOUND BOW FROM THE BOW LIMB ENDS

(76) Inventor: Leon Monroe Pittman, 661 Hubert Pittman Rd., Pendergrass, GA (US) 30567

( * ) Notice: Subject to any disclaimer, the term of this patent is extended or adjusted under 35 U.S.C. 154(b) by 325 days.

(21) Appl. No.: 11/532,615

(22) Filed: Sep. 18, 2006

(65) Prior Publication Data

US 2007/0119438 A1 May 31, 2007

Related U.S. Application Data

(60) Provisional application No. 60/740,119, filed on Nov. 29, 2005.

(51) Int. Cl.
*F41B 5/14* (2006.01)

(52) U.S. Cl. ..... 124/1; 124/80

(58) Field of Classification Search ..... 124/1, 124/23.1, 25.6, 80, 86; 269/139, 237, 242
See application file for complete search history.

(56) References Cited

U.S. PATENT DOCUMENTS

| | | | | | |
|---|---|---|---|---|---|
| 97,872 | A * | 12/1869 | Burkhardt | 269/218 |
| 323,955 | A * | 8/1885 | Patten | 269/242 |
| 922,336 | A * | 5/1909 | Rivers | 269/189 |
| 3,055,655 | A * | 9/1962 | Chelf | 29/235 |
| 3,580,459 | A * | 5/1971 | Gage et al. | 228/2.3 |
| 4,415,149 | A * | 11/1983 | Rees | 269/88 |
| 5,022,377 | A | 6/1991 | Stevens | |
| 5,222,473 | A | 6/1993 | Lint | |
| 5,370,103 | A | 12/1994 | Desselle | |
| 5,425,350 | A * | 6/1995 | Egusquiza | 124/86 |
| 5,433,186 | A | 7/1995 | Corwin | |
| 5,746,192 | A * | 5/1998 | Gissel | 124/1 |
| 6,386,190 | B1 | 5/2002 | Kurtz, Jr. | |
| 6,932,070 | B1 | 8/2005 | Kurtz, Jr. | |
| 6,957,647 | B2 | 10/2005 | Evans et al. | |
| 6,968,834 | B1 | 11/2005 | Gibbs | |
| 7,089,923 | B2 * | 8/2006 | Johnson | 124/1 |
| 2006/0000462 | A1 | 1/2006 | Kurtz, Jr. | |
| 2006/0191522 | A1 | 8/2006 | Henry | |
| 2009/0107475 | A1 * | 4/2009 | Pittman | 124/86 |

* cited by examiner

*Primary Examiner*—John Ricci
(74) *Attorney, Agent, or Firm*—Mitch Harris, Atty at Law, LLC; Andrew M. Harris

(57) ABSTRACT

A compound bow maintenance press and method for compressing a compound bow from the bow limb ends provides a shop-installable bow press that prevents damage to the bow riser and limbs during service. The press contacts the bow only at the ends of the bow limbs and compresses the bow from outside of the curvature of the bow, providing clear access to the bow strings and a press that can be secured or stood on a workbench or a floor stand. The bow press can be operated by an electric motor or a hand crank and may include a worm gear drive system that provides for adjusting a telescoping member having arms extending to compress the bow limb ends. A limb end fixture is attached to or integrated with each arm, and provides a slot that accepts the bow limb end pulleys.

21 Claims, 3 Drawing Sheets

COMPOUND BOW MAINTENANCE PRESS AND METHOD FOR COMPRESSING A COMPOUND BOW FROM THE BOW LIMB ENDS

This application claims priority under 35 U.S.C. §119(e) to U.S. Provisional Patent Application Ser. No. 60/740,119, filed on Nov. 29, 2005.

BACKGROUND OF THE INVENTION

1. Field of the Invention

The present invention relates generally to bow presses for maintenance of archery bows, and more particularly, to a manual and electrically-powered compound bow press that lies outside of the radius of the bow and that compresses a compound bow from the ends of the bow limbs.

2. Description of the Related Art

Bow presses are used in maintenance of archery bows, and in particular, are necessary for the maintenance of compound bows, where the force required to compress the bow in order to remove the bow string(s) and perform other operations can require hundreds of pounds of force.

A typical shop-installed bow press has a form and operation such as that described in U.S. Pat. No. 6,968,834, in which the bow is stabilized at multiple points along its curvature and wherein the force applied to compress the bow is applied by a crank along the direction of the nock and perpendicular to the radius of curvature of the bow. The press is located outside of the curvature of the bow limbs, so that the bow press structure does not interfere with the operator's access to the bowstring and other components while working on the bow. Such bow presses require practice and training in order to properly compress a bow without damaging the riser or limbs. Some bow presses require adjustment of multiple jacks in order to start compressing a bow.

Other bow presses for field use such as those described in U.S. Pat. No. 7,089,923, provide a lightweight and highly portable structure that contracts a bow via tension applied from the inside of the curvature of the bow limbs, and only from the ends of the bow limbs, but the tensioning structure lies in or near the path of the bow string(s) and further is not designed to operated as a secured fixture, as is desirable for use in a bow maintenance shop environment.

It is highly desirable to contract a bow from the ends of the bow limbs, as devices such as that described in the above-referenced U.S. Pat. No. 6,968,834 must necessarily apply force to points along the riser of the bow and other points along the bow limbs other than the bow limb ends. Present-day compound bows are designed to be lightweight and are typically be made of ductile metals and/or fragile composites. In order to lighten such compound bows, as much material as possible is typically removed from the limbs and body of the bow, and such designs vary greatly from manufacturer to manufacturer. Therefore, there is no guarantee that any point along the bow will have sufficient structural strength or elasticity to tolerate a force applied at that point.

However, the ends of the limbs of a bow must be able to tolerate a force along the direction of the bow string at least equal to that applied by the bow string(s) at the point of maximum draw, as that force is applied to the bow in use. Therefore, compound bows typically will be strong at the bow limb ends and most certainly tolerant of a force applied along the direction of the bow string and cable at the bow limb ends, as that force is applied when the bow string is drawn.

Therefore, it would be desirable to provide a maintenance bow press, and in particular a press for compound bows, that contracts the bow by applying force only at the bow limb ends. It is further desirable to provide a bow press that is simple to use and requires little training or effort to service a compound bow without damaging the bow.

SUMMARY OF THE INVENTION

The objective of providing a maintenance bow press for compound bows that applies the contracting force only at the bow limb ends is provided in a bow press and its method of operation.

The bow press includes a retractable frame member and two bow limb end fixtures attached to the ends of the frame member. The bow limb end fixtures define slots for accepting the pulleys at ends of a compound bow and can include both vertical and horizontal restraining portions that secure the bow limb ends at their junction, so that then the retractable frame is retracted, a bow inserted in the bow press is thereby secured during compression.

A central worm gear can be supplied within a telescoping frame to provide for compressing and releasing the bow limb ends, and may be driven by an electric motor.

The foregoing and other objectives, features, and advantages of the invention will be apparent from the following, more particular, description of the preferred embodiment of the invention, as illustrated in the accompanying drawings.

BRIEF DESCRIPTION OF THE DRAWINGS

The novel features believed characteristic of the invention are set forth in the appended claims. The invention itself, however, as well as a preferred mode of use, further objectives, and advantages thereof, will best be understood by reference to the following detailed description of an illustrative embodiment when read in conjunction with the accompanying drawings, wherein like reference numerals indicate like components, and:

DESCRIPTION OF ILLUSTRATIVE EMBODIMENT

The present invention is a bow press that provides for compressing a compound archery bow from outside of the bow limb convex curvature. The press contacts the bow only at the bow limb ends, avoiding damage to the riser and/or limbs of the bow that can be caused by forces applied to the middle portions of the bow, in particular, the bow riser, which can account for up to 50% of the value of the bow.

Figure 1:
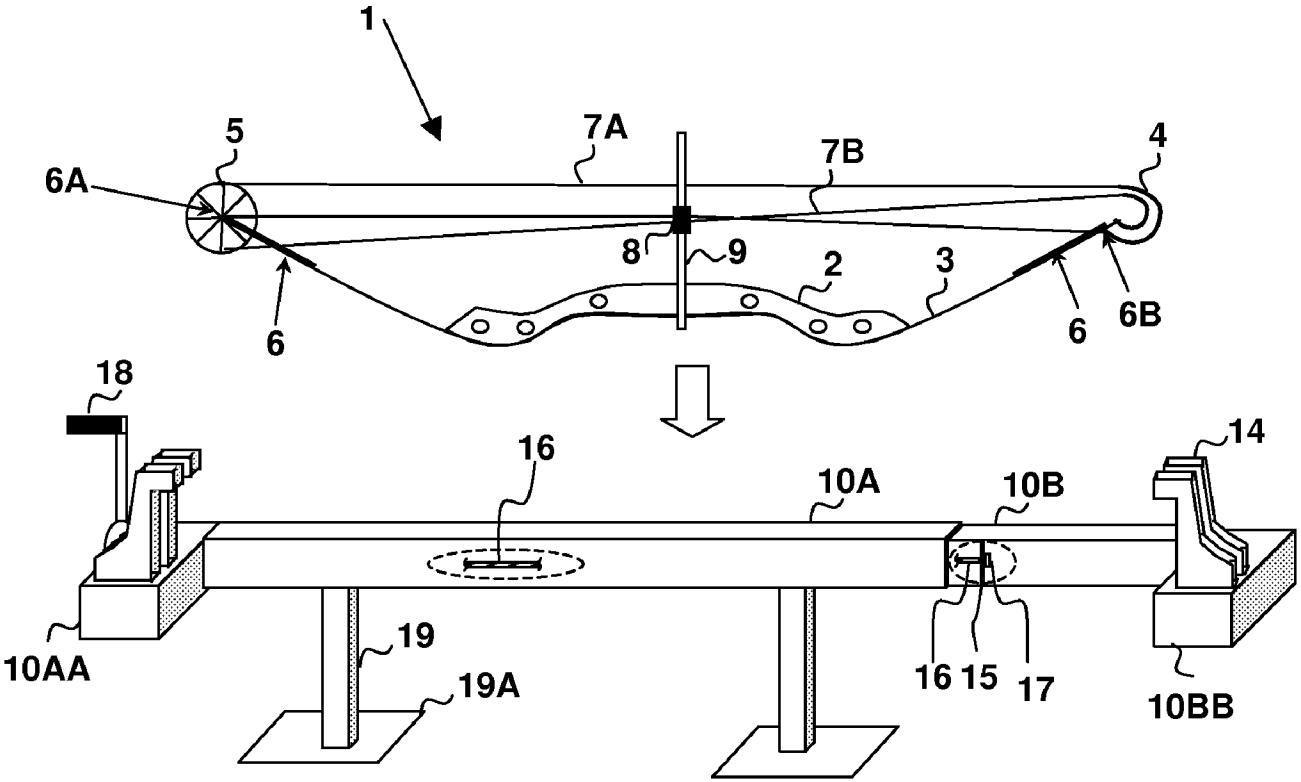
FIG. 1 is an illustration of a bow press in accordance with an embodiment of the invention prepared for receiving a compound bow 1.

Referring now to FIG. 1, a bow press in accordance with an embodiment of the invention is illustrated. In the illustration, the bow press is adjusted to accept insertion of a compound bow 1. Compound bow 1 includes riser 2, and bow limbs 3 that provide the structure of the bow that resists the tension on the bow string 7A and cable 7B. The bow limbs have a reinforced portion 6, which may or may not be split, toward the ends 6A and 6B that support the idler wheel 5 and cam 4, respectively, which in turn provide the bow string 7A and cable 7B paths. A cable guard 9 provides a path for cable slide 8, which is used to pull and steady bow string 7A and cable 7B.

The illustrated bow press includes a telescoping frame member composed of two sections 10A and 10B, which may be made from extruded steel tube with a square cross section, with section 10B having suitable external dimensions to fit within section 10A and slide within section 10B, while retaining lateral stability. A worm gear 16 is included within sections 10A and 10B and is rotatably affixed to section 10B through an internal flange 15 and a lock nut 17, on the opposing end of section 10A a crank handle 18 is attached to worm gear 16 through a suitable collet (not shown). By turning crank handle 18 the telescoping frame member is expanded or collapsed and is shown in the expanded position for receiving bow 1. Stand legs 19 and flanges 19A are provided for mounting the bow press to a workbench or stand. Holes may be provided through flanges 19A for this purpose and may be patterned to accept through-bolts of a prefabricated stand.

Extension arms 10AA and 10BB of frame members 10A and 10B, respectively, provide for the placement of bow 1 away from the central portion of the bow press, so that bow 1 does not interfere with frame members 10A and 10B as the bow is compressed. A set of bow limb end fixtures 14 is provided on extension arms 10AA and 10BB to retain the bow limb ends of bow 1 in the bow press and may be particularly adapted for different types of bow ends as will be described below in further detail. The only force applied from the depicted bow press to bow 1 is a force applied to the bow limb ends 6A and 6B, with no contact made between the bow press and riser 2 or the portion of bow limbs 3 that is substantially away from bow limb ends 6A and 6B.

Figure 2:
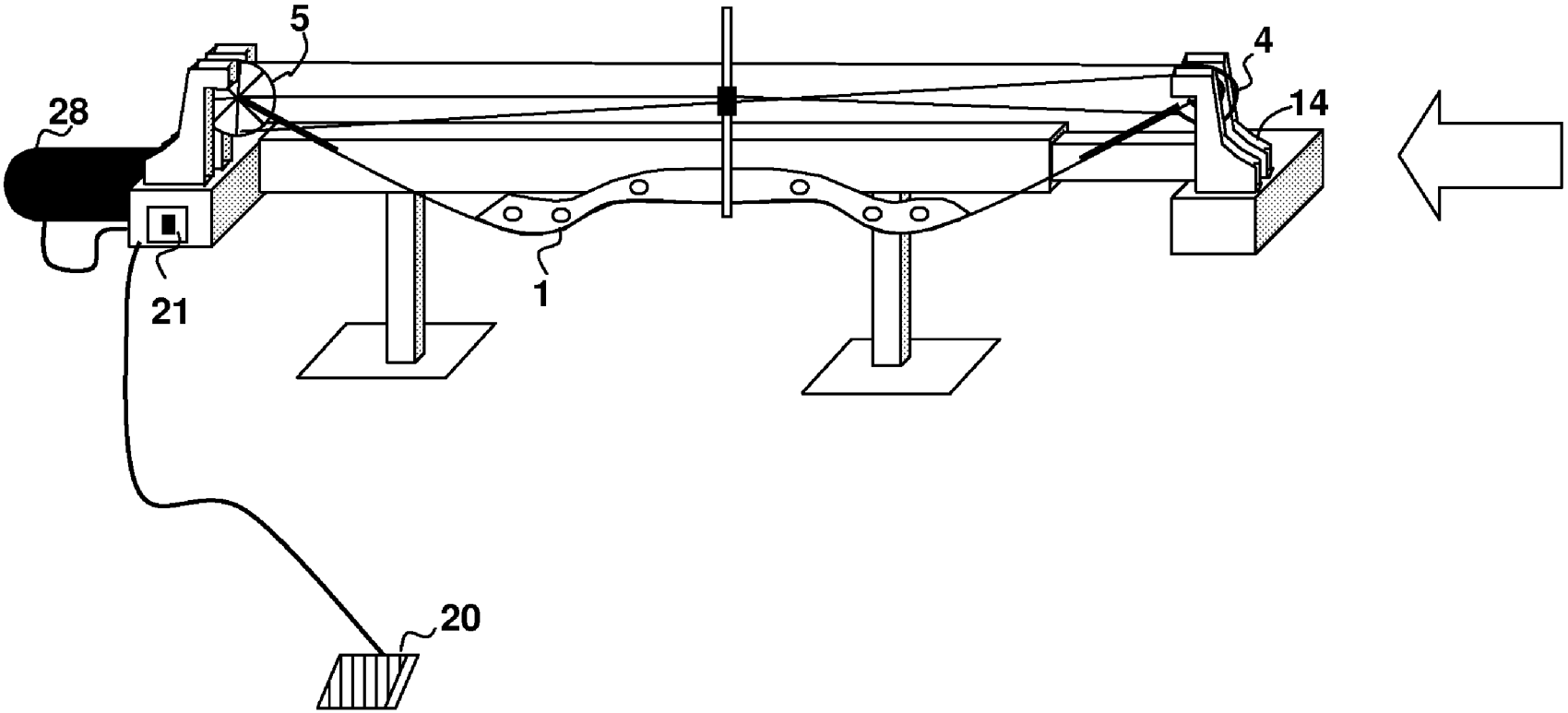
FIG. 2 is a pictorial diagram of a bow press in accordance with another embodiment of the invention, with a compound bow 1 installed.

Referring now to FIG. 2, a bow press in accordance with another embodiment of the present invention is shown, and is also further used to illustrate the operation of the bow presses of both FIGS. 1 and 2 when bow 1 is inserted in one of the bow presses of the present invention. As shown, bow limb end fixtures 14 are located on either side of idler wheel 5 and cam 4, so that idler wheel 5 and cam 4 do not receive any compressive force from the bow press. The depicted embodiment is similar to that of the bow press of FIG. 1 and therefore only differences between them will be described. In particular, FIG. 2 illustrates that when bow 1 is inserted in the bow press, all of the bow press elements lie outside of the primary (convex) curvature of the bow, except for the tips of the bow limb end fixtures 14. Some bows may have multiple curvatures, but the primary curvature includes within it the bulk of the bow string and bow cable, if present. Thus, the primary curvature of bow 1 is the arc along the body of the bow that extends between bow limb end 6A to bow limb end 6B.

In the depicted embodiment, the compressive force is applied by a motor 28 rather than the crank handle 18 of FIG. 1. Motor 28 is operated by a safety cutoff switch 21 as is well known in the state of the art for power tool operations. Cutoff switch 21 can only be activated, in reverse or forward direction, by lifting a cover, but can be deactivated with slight contact, providing safety in operation. A footswitch 20 further provides for hands-off operation of motor 28 once cutoff switch 21 is engaged, so that an operator can control positioning of bow 1 as frame members 10A and 10B are driven together.

To operate the bow press, the operator positions bow 1 in the bow press as shown, and activates switch 21 in the forward (closing) direction until bow 1 is sufficiently compressed to remove cable 7A and bow string 7B. After servicing is complete, switch 21 is activated in the reverse direction, releasing the compression applied to the bow by frame members 10A and 10B, until the bow limb end fixtures 14 are sufficiently separated that bow 1 can be easily removed.

Figure 3B:
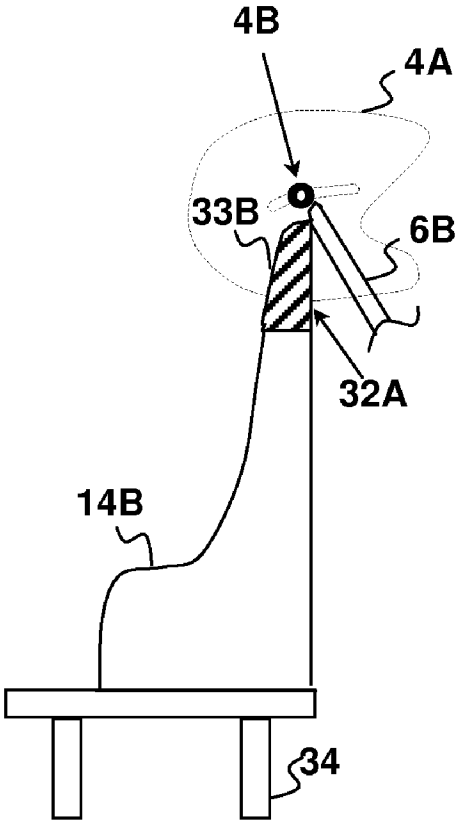
FIGS. 3A and 3B are illustrations showing details of bow limb end fixtures 14 of FIGS. 1 and 2.
Figure 3A:
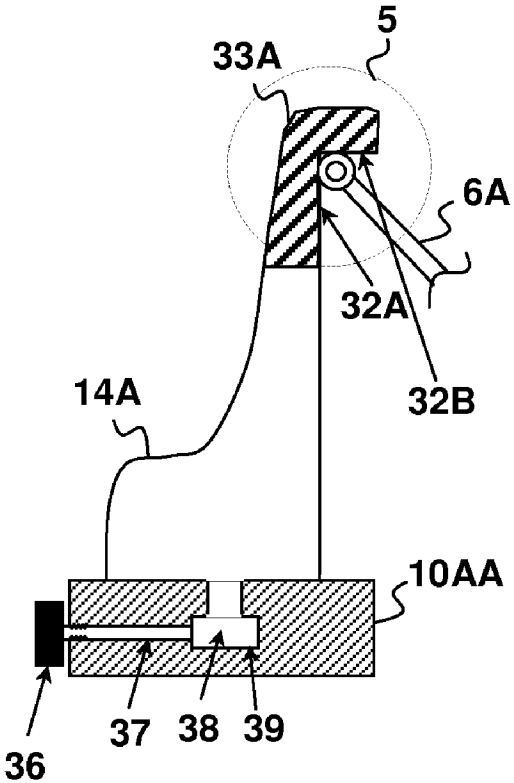

Referring now to FIGS. 3A and 3B, details of bow limb end fixtures 14 are shown. FIG. 3A shows a bow limb end fixture 14A suitable for use on most bows. Bow limb end fixture 14A has a hooked end with a perpendicular surface 32A and a parallel surface 36B with respect to the orientation of the bow string and cable. A rubber boot 33A is provided over the tip of bow limb end fixture 14A to prevent scratching or other damage to bows. Bow limb end 6A contacts both surfaces 32A and 32B providing a secure retention of bow 1 when compressive force is applied by the bow press. In order to accommodate bows of different widths and design features, bow limb end fixture 14A illustrates a connection to extension arm 10AA that provides for sliding bow limb end fixture 14A in an axis perpendicular to the page. One or both of the bow limb end fixtures 14A for each pair mounted to extension arms 10AA and 10BB may be made slidable by including a T-shaped channel 39 in extension arms 10AA and 10BB, and providing the base of bow limb end fixtures 14A with a T-shaped protrusion 38 that fits securely and slidably within channel 39. Turnscrews 33A and knobs 36 can be provided to secure bow limb end fixtures 14A within channels 39, so that the bow press can be adapted to a wide variety of bow widths and designs.

Further, some bows have features at or beyond the end of the bow limb ends that cannot be contacted with the force applied to the bow by the bow press of the present invention. Therefore, special bow limb end fixtures are used for such bow ends. Bow limb end fixture 14B illustrates such a fixture that can be used when compressing a bow that includes an adjustment knob 4B for cam 4A that provides for rotation of cam 4A. Bow limb end fixture 14B has only the perpendicular surface 32A, the tip of which is used to contact bow limb end 6B to apply the compressive force, avoiding contact with adjustment knob 4B. Generally, only one such bow limb end fixture 14B is needed on one side of the bow under such circumstances, and a bow limb end fixture such as bow limb end fixture 14A as shown in FIG. 3A can still be used as the other bow limb end fixture 14 in a pair at bow limb end 6B. The second (standard) bow limb end fixture 14A then secures the bow from rising out of the bow press when the bow is compressed. FIG. 3B also illustrates an alternative attachment, wherein bow limb end fixtures 14 can be made detachable as shown and pins or bolts 34 used to retain bow limb end fixtures 14 to frame member extension arms 10AA and 10BB of FIGS. 1-2. Multiple hole positions may be provided in frame member extension arms 10AA and 10BB for reconfiguring the bow limb end fixtures 14, but without the continuously adjustable positioning provided by the attachment scheme depicted in FIG. 3A.

While the invention has been particularly shown and described with reference to the preferred embodiment thereof, it will be understood by those skilled in the art that the foregoing and other changes in form, and details may be made therein without departing from the spirit and scope of the invention. For example, the telescoping frame member provided by the above-illustrated frame member sections 10A and 10B may be replaced with other suitable design choices that provide a retractable support for bow limb end fixtures 14 so that compressive force can be applied to the bow. Therefore the invention should not be understood to pertain to a particular design depicted in the illustrations, which are exemplary of a particular mechanism that can provide for compressing a bow from the bow limb ends with a rigid structure outside of the primary curvature of the bow. As another example, extension arms 10AA and 10BB can be fabricated to extend upward from frame members 10A and 10B at sufficient height that bow 1 will not ever contact frame members 10A and 10B, at the sacrifice of compactness of the bow press.

What is claimed is:

1. A bow press for servicing a compound archery bow, the bow press comprising:

a pair of bow limb end fixtures for securing bow limb ends of the bow, and providing the sole points of application of force for compressing the bow when the bow is mounted in the bow press;

a bench-top or floor mountable mechanism located outside of a volume occupied by the bow when the bow is mounted in the bow press for servicing, the mechanism for compressing the bow by moving at least one of the pair of fixtures to increase a sole compressive force that compresses the bow for performing the servicing, and wherein the mechanism is located outside of a primary convex curvature of the bow both within the bow and as projected beyond the bow limb ends, whereby the mechanism does not interfere with access to a bow string of the bow for servicing, and wherein the bow limb end fixtures comprise extensions defining a gap therebetween for contacting the bow limb ends on either side of a cam or an idler wheel of the bow, whereby compressive force of the bow press is not applied to the cam or the idler wheel.

2. The bow press of claim 1, wherein the mechanism is located alongside a region extending between the pair of fixtures and displaced from the pair of fixtures in a direction perpendicular to a plane of the primary convex curvature of the bow, wherein when the bow is mounted in the bow press, the mechanism is located alongside the bow.

3. The bow press of claim 1, wherein the mechanism comprises a retractable frame member mechanically secured to the pair of fixtures, and wherein a retraction of the frame member provides the sole compressive force.

4. The bow press of claim 3, wherein the retractable frame member is a telescoping frame member formed from two frame member portions, with one of the frame member portions slidably inserted in the other one of the frame member portions.

5. The bow press of claim 4, wherein the telescoping frame member further comprises a pair of extension arms, one secured at each end of the telescoping member and extending from the telescoping member in a direction perpendicular to a telescopic axis of the telescoping member, and wherein the pair of fixtures is each mechanically secured to a corresponding one of the extension arms.

6. The bow press of claim 5, whereby the extension arms extend in a direction perpendicular to the primary plane of convex curvature of the bow, whereby the bow is prevented from contacting the retractable frame member when the bow is compressed.

7. The bow press of claim 4, wherein the telescoping frame member includes a worm gear internal to the telescoping frame member and rotatably affixed to the frame member portions such that the worm gear may be rotated to retract or extend the telescoping frame member.

8. The bow press of claim 7, further comprising a hand crank mechanically coupled to the worm gear for rotating the worm gear.

9. The bow press of claim 1, further comprising an electric motor mechanically coupled to the mechanism for moving the at least one of the pair of fixtures to compress the bow.

10. The bow press of claim 1, wherein the extensions of the bow limb end fixture have a pair of perpendicular surfaces that contact the bow, one extending in a direction passing over a tip of the bow limb end along a primary direction of a bow string of the bow and a second one extending in a direction of the curvature of the bow, whereby the bow limb ends are secured by contact with both surfaces of the extensions of the bow limb end fixtures when the bow is compressed by the bow press.

11. The bow press of claim 1, wherein the bow limb end fixtures are interchangeable, and wherein at least one of the interchangeable bow limb end fixture extensions has a single surface that contacts the bow, and extends in a direction of the curvature of the bow, whereby at least one feature of the bow that is located past a corresponding bow limb end and away from a center of the bow is prevented from contacting the bow limb end fixture.

12. A method of servicing an archery bow, comprising:

compressing the bow by applying force from a bench-top or floor mountable mechanical bow press only at bow limb ends of the bow, wherein the force is provided by moving a mechanism lying outside of a primary curvature of the bow both within the bow and as projected beyond the bow limb ends, whereby the mechanism does not interfere with access to a bow string of the bow for servicing; and releasing the bow by moving the mechanism to expand the bow.

13. The method of claim 12, wherein the compressing comprises moving a mechanism located alongside a region extending between the pair of fixtures and displaced from the pair of fixtures in a direction perpendicular to a plane of the primary convex curvature of the bow, wherein when the bow is mounted in the bow press, the mechanism is located alongside the bow.

14. The method of claim 12, wherein the compressing comprises retracting a telescoping frame formed from two frame member portions forming the telescoping frame, wherein one of the frame member portions slides within the other frame member portion.

15. The method of claim 14, further comprising displacing the bow from the telescoping member using a pair of extension arms, one secured at each end of the telescoping member and extending from the telescoping member in a direction perpendicular to a telescopic axis of the telescoping frame.

16. The method of claim 14, wherein the retracting further comprises rotating a worm gear internal to the telescoping frame member.

17. The method of claim 12, wherein the compressing is performed by activating an electric motor mechanically coupled to the mechanism.

18. A bow press for servicing a compound archery bow, the bow press comprising:

bench-top or floor mountable means for securing bow limb ends of the bow, and providing the sole points of application of compressive force for compressing the bow when the bow is mounted in the bow press;

means for preventing force from being applied to at least one of a cam or idler wheel located at one of the bow limb ends of the bow; and means lying outside of a primary curvature of the bow both within the bow and as projected beyond the bow limb ends, for moving the securing means together to compress the bow.

19. The bow press of claim 18, wherein the means for moving includes an electric motor.

20. The bow press of claim 18, further comprising means for displacing the bow from a primary axis of the moving means, whereby the bow is prevented from contacting the means for moving.

21. The bow press of claim 18, further comprising interchangeable means for preventing contact between the preventing means and a feature of the bow located away from a center of the bow and past one of the bow limb ends.

* * * * *